US006318271B1

(12) United States Patent
Clark

(10) Patent No.: US 6,318,271 B1
(45) Date of Patent: Nov. 20, 2001

(54) FUSE IGNITER ADAPTER ASSEMBLY

(75) Inventor: Lawrence D. Clark, Lorton, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/556,338

(22) Filed: Apr. 24, 2000

(51) Int. Cl.[7] ..... C06C 5/04
(52) U.S. Cl. ..... 102/275.7
(58) Field of Search ..... 102/275.7, 275.6, 102/275.12, 275.4, 200, 275.1

(56) References Cited

U.S. PATENT DOCUMENTS 4,660,472 * 4/1987 Stevens ..... 102/202.1
5,299,500 * 4/1994 Lindquist et al. ..... 102/275.12
5,327,835 * 7/1994 Adams et al. ..... 102/275.11

* cited by examiner

*Primary Examiner*—Charles T. Jordan
*Assistant Examiner*—Jordan Lofdahl
(74) *Attorney, Agent, or Firm*—Milton W. Lee; John E. Holford; Alain L. Bashore

(57) ABSTRACT

A fuse igniter adapter assembly that adapts various fuse cord sizes to a firing device for ignition by a primer. The assembly includes a hub subassembly, four retaining blades, a circular slide element, a circular cap element, a spring, and a snap ring.

2 Claims, 3 Drawing Sheets

FUSE IGNITER ADAPTER ASSEMBLY

BACKGROUND OF THE INVENTION

1. Field of the Invention

The present invention generally relates to fuse igniter adapters and more specifically, to a fuse igniter adapter assembly that adapts various fuse cord sizes to various firing devices.

2. Description of Prior Art

An important fuse utilized in the explosives, ordinance and demolition community is fuse cord, used to initiate high explosive detonators. Fuse cord commonly comprises a woven fabric tube of reinforced with wrappings of fiber or metal, and impregnated with asphalt and wax. Filled at its core is a high burn rate material. The type of flammable used and the diameter of the cord determines the rate at which it burns. The cord functions as a conduit of detonative energy.

With the large variety of commercial and military types of fuse cords, there is a difficulty in the prior art regarding a device for adapting various fuse cord sizes to various firing devices. This is especially true for the diameter size 0.107 to 0.150 for which no useable adapter is available. While the prior art has reported using fuse cord, none have established a basis for a specific apparatus that is dedicated to the task of resolving the particular problem at hand. What is needed in this instance is a fuse igniter adapter assembly that adapts various fuse cord sizes to various firing devices.

SUMMARY OF THE INVENTION

It is therefore one object of the invention to provide a fuse igniter adapter assembly that adapts various fuse cord sizes to various firing devices.

According to the invention, there is a fuse igniter adapter assembly that adapts various fuse cord sizes to a firing device for ignition of the fuse cord by a primer. A hub subassembly includes an adapter segment, a deflector segment, and a blade retaining segment. The adapter segment includes means for releasable connection to the firing device and a cavity for insertion of the primer. The deflector segment includes a shield, frustro-conical in shape, radiating outward thirty degrees from the radial axis for blast deflection. There is also included an annulus immediately following and within the shield including four exhaust ports in communication with said axial passage for blast exhaust. A diverter element immediately following said annulus on said radial axis diverts exhaust from a blade retaining section and functions as a spring stop. The blade retaining segment after said deflector segment includes four blade slots each with a blade passage along said planer axis to hold four retaining blades.

Each retaining blade is elongated and inserted within the blade slots. A retaining blade includes a bowed textured edge, a rounded end, and a pointed end. The bowed sharpened edge is sildingly held within the blade passage and said rounded end and pointed end in-between a slide element and cap element respectively. A spring is present for spring compression of said circular slide element against the pointed ends. Releasably held about a radial groove at the end of the assembly is a snap ring providing a stop for the circular cap element.

The primer is inserted into the cavity and a firing mechanism releasably attached. The circular slide element is pulled rearward, overriding the spring and thus releasing the four retaining blades to allow insertion of the fuse cord. The circular slide element is released allowing spring compression to hold the bowed textured edges to releasably hold the fuse cord in place. The firing mechanism is actuated thereby striking the primer, which ignites the fuse and gases escapes from the radial passage through the exhaust ports.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
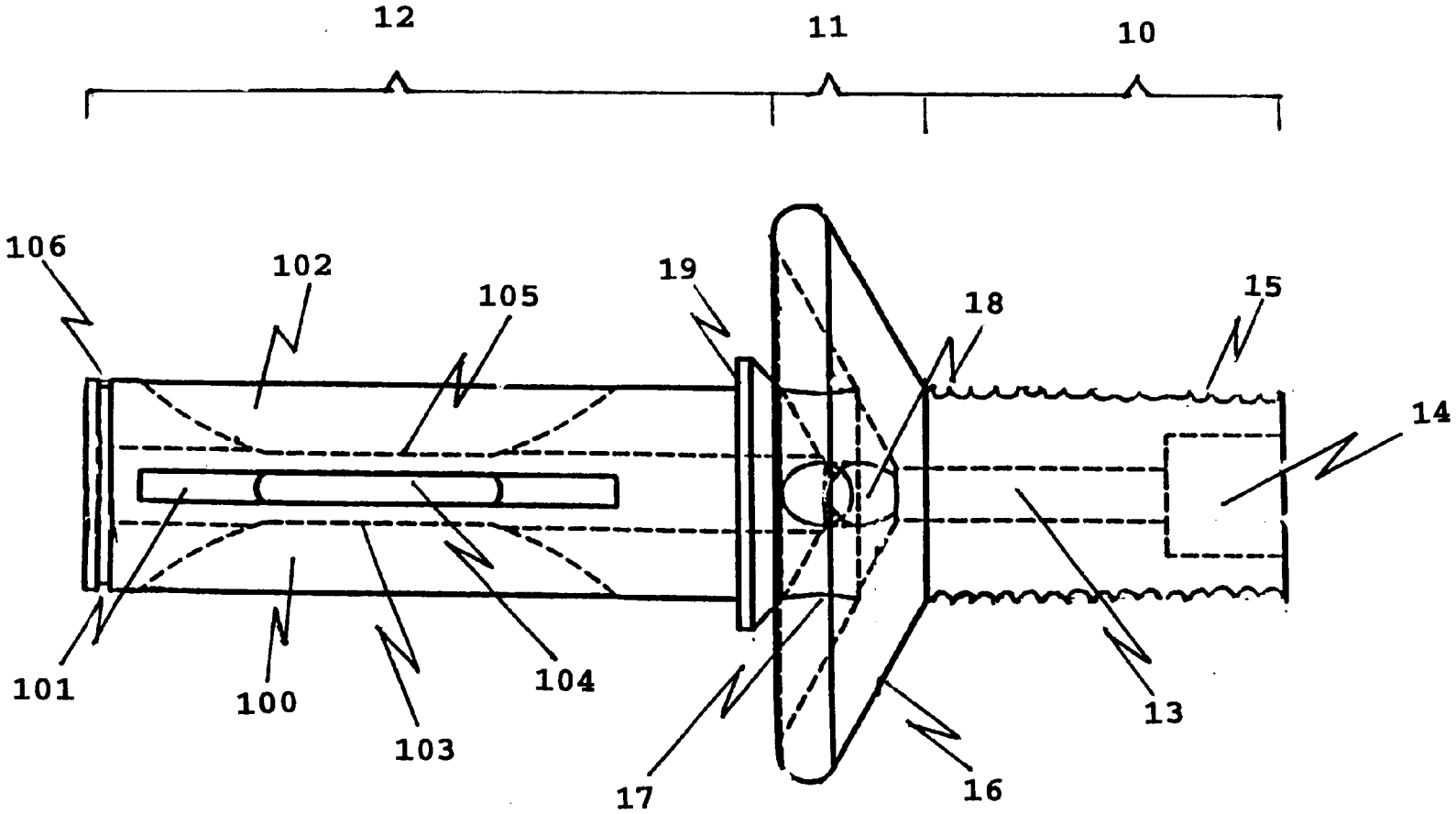
FIG. 1 is a side view of the hub subassembly of the invention.

Referring now to the drawings, and more particularly to FIG. 1, there is shown a side view of the hub subassembly of the fuse igniter adapter assembly. The hub subassembly shown in FIG. 1 is generally cylindrical, with a first and second end, and includes an adapter segment 10, deflector segment 11, and blade retaining segment 12. Passage 13 is shown through the radial center of the hub subassembly communicating along the entire length of the hub subassembly. Adapter segment 10 allows for releasable connection to a firing apparatus and provides within cavity 14 for insertion at the first end of a primer. Adapter segment 10 on its surface has thread 15 as a releasable connection means to couple the entire fuse igniter adapter assembly to a firing apparatus. Deflector segment 11 includes shield 16, with a frustro-conical shape, radiating outward thirty degrees immediately following adapter segment 10 for blast deflection. Annulus 17 immediately below shield 16 includes four exhaust ports (exhaust port 18 shown in FIG. 1) in communication with passage 13 and the surface of annulus 17 which allow for blast exhaust to escape passage 13 without destroying the assembly. Each exhaust port is positioned at ninety degrees to each other, and an individual exhaust port is thirty degrees from normal to surface of annulus 17. Diverter 19 positioned below annulus 17 forms the end portion of deflector segment 11. Diverter 19 diverts the blast away from blade retaining section 12 and acts as a spring stop for the fuse igniter adapter assembly.

Blade retaining segment 12 includes four blade slots each at ninety degree angles. Each blade slot (blade slots 100, 101, 102 shown in FIG. 1) is arcuately plunged to an offset of passage 13, and each slot includes a passage opening (passage openings 103, 104, 105) in communication with passage 13. Preceding the second end of the fuse igniter adapter assembly is radial groove 106 located after the four blade slots, where radial groove 106 allows for releasably holding a snap ring.

Figure 2:
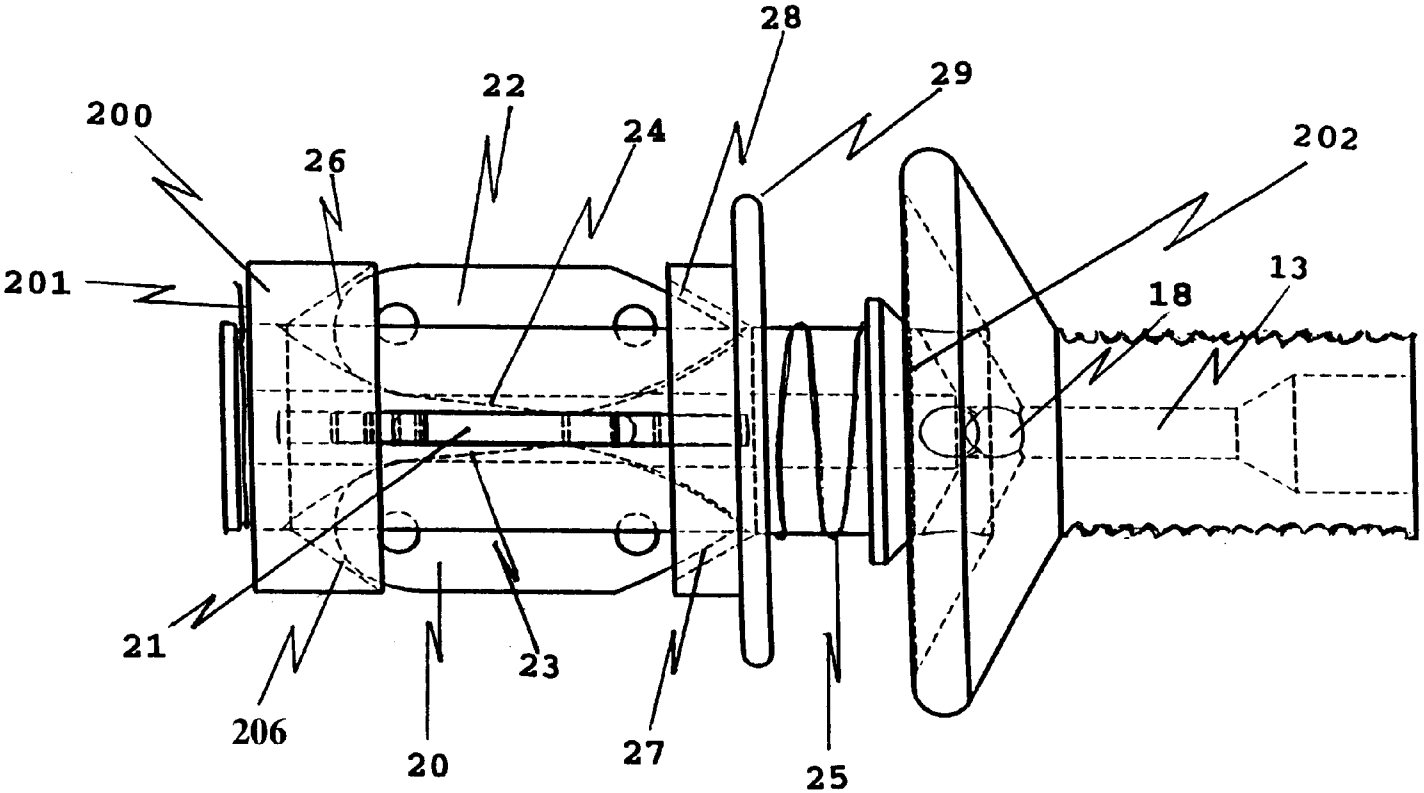
FIG. 2 is a side view of the entire assembly of the invention.

FIGS. 2 is a side view of the entire fuse igniter adapter assembly of the present invention. Four retaining blades (blades 20, 21 and 22 are shown in FIG. 2) are utilized, each retaining blade includes a bowed textured edge, a rounded end, and pointed end. Retaining blade 20 and 22 shows bowed textured edges 23 and 24, rounded ends 206 and 26, and pointed ends 27 and 28 respectively. Each retaining blade is slidingly held within a blade slot by axial compression in-between slide 29 and cap 200. Slide 29 and cap 200 include interior side walls that are pointed-shaped for engaging the pointed ends of each retaining blade and allowing radial movement of the rounded ends and thus movement of the textured edge. The textured edge of each blade applies inward pressure equally into passage 13 via the blade openings for releasably holding a fuse cord inserted within passage 13. Slide 23 is spring compressed by spring 25 above one end of the passage openings while cap 24 is held in place by snap ring 201 positioned about radial groove 106. Diverter 18 of FIG. 1 acts as a spring stop for spring 25 of FIG. 2. The adjustability and security for the fuse cord is accommodated by the four floating blades, which are self-centering. Fuse stop 29 for the fuse provides a positive position to ensure the fuse does not restrict the 3/32" vent holes for the escaping gases from the primer. Fuse stop 202 is facilitated via a restriction of passage 13 at the blade 20, 21 & 22 side of the annulus 17 to a diameter of 0.093" thereby restricting entry of the fuse into the vent area.

Figure 3:
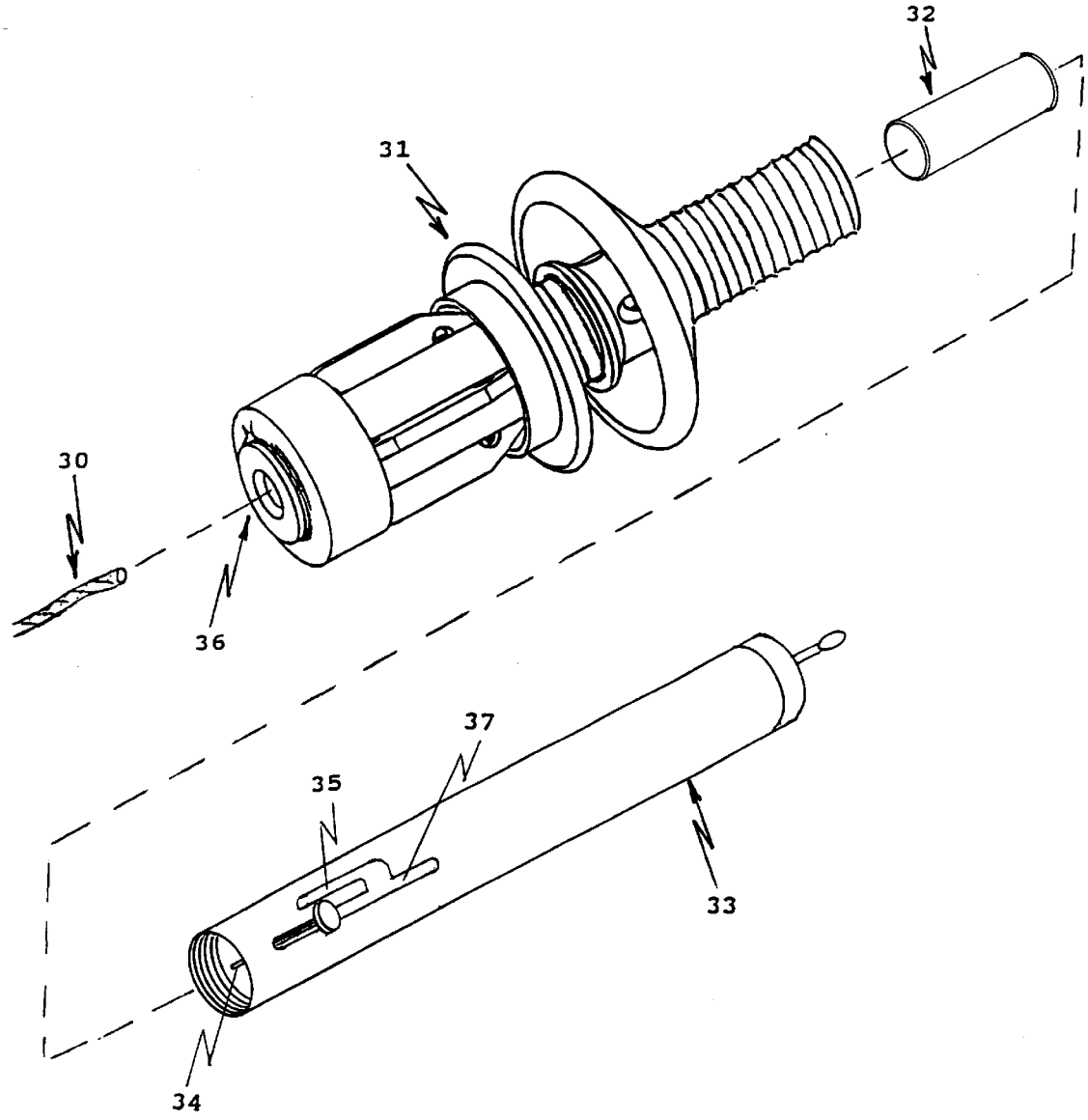
FIG. 3 is an exploded pictorial view of a fuse cord section, the entire assembly of the invention, a shot gun shell primer and a hand-held firing mechanism.

FIG. 3 is an exploded pictorial view of fuse cord section 30, fuse igniter adapter assembly 31, shot gun shell primer 32 and handheld firing mechanism 33. Fuse adapter assembly 31 can accept a variety of commercial and military explosive fuses ranging in diameter from 0.107 to 0.150. This range can readily be expanded up or down with minor dimensional changes without instilling other limitations.

Shot gun shell primer 32 in the preferred embodiment is a 12 gage size which is inserted into fuse igniter adapter assembly 31 within cavity 14 of FIG. 1. Handheld firing mechanism 33 shown in FIG. 3 is part of a prior art flare system known under the trade name PENFLARE. Firing pin 34 is set at safety position 35 after which fuse igniter adapter assembly 31 is then screwed on. Slide 23 on fuse igniter adapter assembly 31 is pulled rearward, overriding spring 25, releasing the four retaining blades. Fuse cord section 30 is installed in hole 36 in the end of fuse igniter adapter assembly 31 until it is secured at stop 29. The type and length of fuse cord is not limited for use in the present invention. For the preferred embodiment the use of fuse cord under the trade name SHOCK TUBE with a diameter of approximately three (3) mm is utilized. Slide 23 released and spring 25 indirectly provides compression on the fuse surface thus securing it. The entire unit is then held at arms length with the fuse pointing away from the operator. Firing pin 34 is then removed from safety position 35 and moved to full-cocked position 37 and released. The primer fires igniting the fuse. The gases escape from the chamber through the exhaust ports, which are four 3/32" diameter holes, directed away from the operator by the angle of the holes. The permanent deflector is set 30 degrees from normal to the central axis toward the fuse insertion end of the adapter.

Many other types of firing mechanisms can be used which utilize the mechanical action of a firing pin or equivalent. A pistol grip firing mechanism is an example that can be used for handheld firing. A mechanical timer firing mechanism is an example that can be used for non-handheld firing. The attachment means for the firing mechanism must match that used on the first end of the fuse igniter adapter assembly. Any combination of an electric timer providing for release of a firing pin form of art could be employed to provide activation of the primer.

While this invention has been described in terms of preferred embodiment consisting of an assembly utilizing, those skilled in the art will recognize that the invention can be practiced with modification within the spirit and scope of the appended claims.

Having thus described my invention, what I claim as new and desire to secure by Letters Patent is as follows:

1. A fuse igniter adapter assembly that adapts various fuse cord sizes to a firing device for ignition of the fuse cord by a primer comprising:

a hub subassembly generally cylindrically shaped about a radial axis, having first and second ends along a planar axis, and an axial passage communicating between said first and second ends through said radial center, said hub subassembly including, an adapter segment at said first end on said radial axis further including means for releasable connection to the firing device and a cavity open to said first end and in communication with said axial passage for insertion of the primer within, a deflector segment after said adapter segment on said radial axis further including a shield, frustro-conical shaped, radiating outward thirty degrees from said radial axis for blast deflection, an annulus immediately following and within said shield including four exhaust ports in communication with said axial passage for blast exhaust, and a diverter element immediately following said annulus on said radial axis for diverting exhaust from a blade retaining section and a spring stop, a blade retaining segment after said deflector segment extending to said second end on said radial axis, further including four blade slots along said planer axis, each blade slot arcuately plunged to an offset of said passage and each blade slot further including a blade passage opening in communication with said axial passage, and a radial groove approximate to said second end for holding a snap ring;

four retaining blades for releasably retaining the fuse cord, each said retaining blade elongated and inserted within said blade slots, each of said retaining blades including a bowed sharpened edge, a rounded end, and a pointed end, said bowed sharpened edge sildingly held within said blade passage and said rounded end and pointed end in-between a slide element and cap element respectively;

a circular slide element about said hub subassembly for releasably holding said pointed ends partially within said four blade passages, said slide element a ring shaped cup having slanting interior side walls, a circumferential outward lip and an open annular center through which said hub subassembly is present after said deflector segment, said slanting side walls slidingly held in spring compression against said pointed ends;

a circular cap element about said hub subassembly for holding said rounded ends partially within said blade passages, said cap element a ring shaped cup having slanting interior side walls and an open annular center through which said hub subassembly is present before said slanting side walls held against said rounded ends and said circular cap element held against said snap ring;

a spring for spring compression of said circular slide element against said pointed ends, said spring about said hub subassembly where said spring has a first end against said circular cap and a second end against said diverter element;

a snap ring releasably held about said radial groove for proving a stop for said circular cap element, whereby the primer is inserted into said cavity and a firing mechanism releasably attached, said circular slide element pulled rearward, overriding said spring and thus releasing said four retaining blades allowing insertion of the fuse cord in said second end of the fuse igniter adapter assembly after which said circular slide element is released allowing said spring compression to hold said bowed sharpened edges to releasably hold the fuse cord in place, the firing mechanism actuates thereby striking the primer which ignites the fuse and gases escape from the radial passage through said exhaust ports.

2. The fuse igniter adapter assembly of claim 1 wherein said means for releasable connection to the firing device is a threaded surface.

* * * * *